United States Patent [19]

Diamond

[11] Patent Number: 4,719,652

[45] Date of Patent: Jan. 19, 1988

[54] RECESSED CAVITY AND COVER FOR BATHTUBS AND THE LIKE

[76] Inventor: Harvey E. Diamond, 12953 Woodbridge St., Studio City, Calif. 91604

[21] Appl. No.: 921,366

[22] Filed: Oct. 20, 1986

Related U.S. Application Data

[63] Continuation of Ser. No. 767,499, Aug. 20, 1985, abandoned, which is a continuation of Ser. No. 572,703, Jan. 20, 1984, abandoned.

[51] Int. Cl.[4] ..... A47K 3/00

[52] U.S. Cl. ..... 4/559; 4/584

[58] Field of Search ..... 4/198, 199, 201, 203, 4/204, 206, 488, 504, 538, 590, 542–544, 546, 548, 549, 553, 557, 559, 580, 584, 591, 507, 628, 661; 16/286, 296

[56] References Cited

U.S. PATENT DOCUMENTS

| | | | |
|---|---|---|---|
| 403,494 | 5/1889 | Streeter | 16/286 |
| 559,478 | 5/1896 | Bunting | 16/286 X |
| 1,475,838 | 11/1923 | Lamb | 16/286 X |
| 2,572,463 | 10/1951 | Fine | 4/590 X |

FOREIGN PATENT DOCUMENTS

| | | | |
|---|---|---|---|
| 319119 | 9/1929 | United Kingdom | 4/584 |

*Primary Examiner*—Charles E. Phillips
*Attorney, Agent, or Firm*—Drucker & Sommers

[57] ABSTRACT

The invention is directed to a novel form of recessed cavity and cover therefor, for use with bathtubs and the like, especially whirlpool baths, and in particular, for use as an overflow recessing device or means.

In the prior art, overflow devices have projected from the bathtub wall. Such overflow devices thus present an obstruction and danger to a bathtub user.

The invention herein recesses the overflow device behind the plane of the bathtub wall, and the recess is provided with a complementary cover so that the recess in the wall, in effect, can be made flush with the wall of the tub. The recess cover is pivotally connected to the bathtub recess opening.

The covered recess is provided with a secondary drain means so that any water entering the covered recess will readily drain therefrom.

10 Claims, 6 Drawing Figures

RECESSED CAVITY AND COVER FOR BATHTUBS AND THE LIKE

RELATED APPLICATIONS

This application is a continuation of co-pending application Ser. No. 767,499, filed Aug. 20, 1985, which was a continuation of application Ser. No. 572,703, filed Jan. 20, 1984, both now abandoned.

SUMMARY OF THE INVENTION

The invention is directed to a novel form of recessed cavity and cover therefor, for use with bathtubs and the like, especially whirlpool baths, and in particular, for use as an overflow recessing device or means.

In the prior art, overflow devices have projected from the bathtub wall. Such overflow devices thus present an obstruction and danger to a bathtub user. In U.S. Pat. No. 2,572,463, a soapdish/closure for the bathtub recess pivots about a hinge pin between an open position projecting into the bathtub, which is unsafe and which cramps the space therein, and a recess-sealing closed position which prevents draining of water from the recess. In U.S. Pat. No. 319,119, there is no recess cover whatsoever.

The invention herein recesses the overflow device behind the plane of the bathtub wall, and the recess is provided with a complementary cover so that the recess in the wall, in effect, can be made flush with the wall of the tub. The recess cover is pivotally connected to the bathtub recess opening.

The covered recess is provided with a secondary drain means so that any water entering the covered recess will readily drain therefrom.

DETAILED DESCRIPTION OF THE INVENTION

Figure 1:
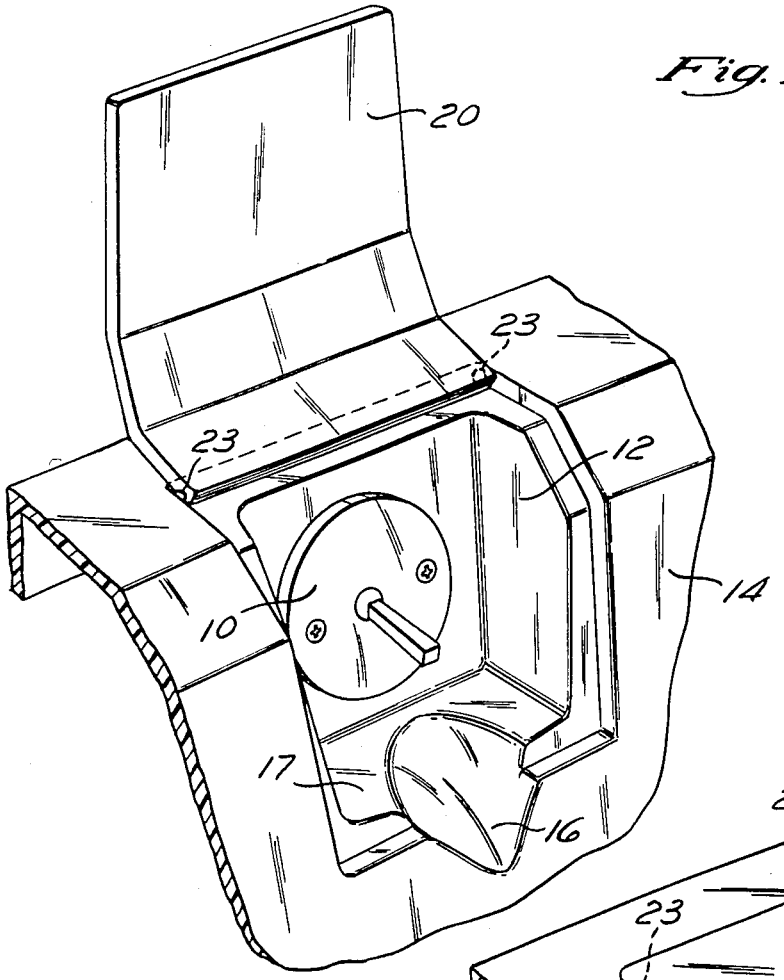
FIG. 1 is a perspective view of the invention showing the recess with the cover pivotally connected thereto in open position.

In the preferred embodiment, an overflow valve of conventional construction is designated by the numeral 10. The overflow valve is shown in a recess or cavity 12 of a bathtub wall 14. The recess 12 has a drain channel or groove 16 formed at the lower surface wall 17 thereof. The recess 12 is further provided with a hinged cover 20 which overhangs the recess. The in-place cover 20 lies flush with the adjacent bathtub wall 14 and permits a user to lie comfortably against the bathtub wall and cover 20, if desired, when the cover 20 is in place—especially important in whirlpool bathtubs and other bathtubs where the entire wall area of the tub may be used by one or more persons.

Figure 2:
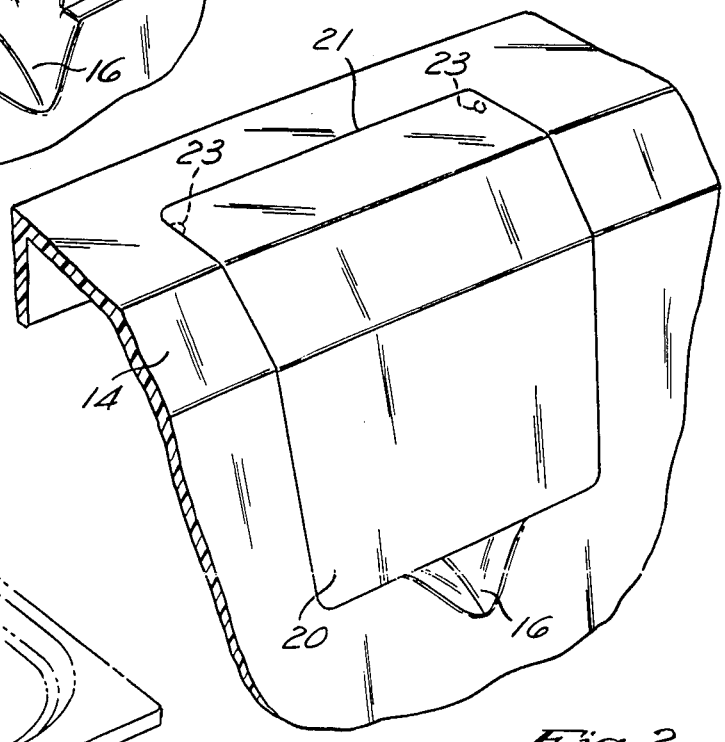
FIG. 2 is a similar perspective view as that of FIG. 1 but with the cover in closed position.
Figure 3:
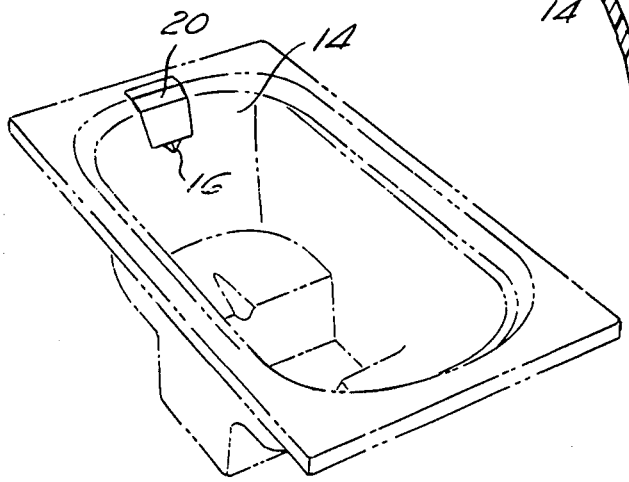
FIG. 3 is a perspective view showing the placement of the recess and cover in a bathtub.

The cover 20 may be hinged at its back edge 21 by hinge pins 23, in the embodiment in FIGS. 1–3. Hinge pins 23 project from the side opening-defining portions of the bathtub, and interfit in complementary openings in cover 20, for enabling the cover 20 to be opened for access to the overflow valve 10. The drain channel 16 is not obstructed by the cover 20 in closed position thereof. The cover 20 may be pivoted into open position (FIG. 1) by finger access to the front edge 19 thereof through drain channel 16 (FIG. 2), and by then pivoting the cover 20 upwardly about hinge pins 23.

Figure 4:
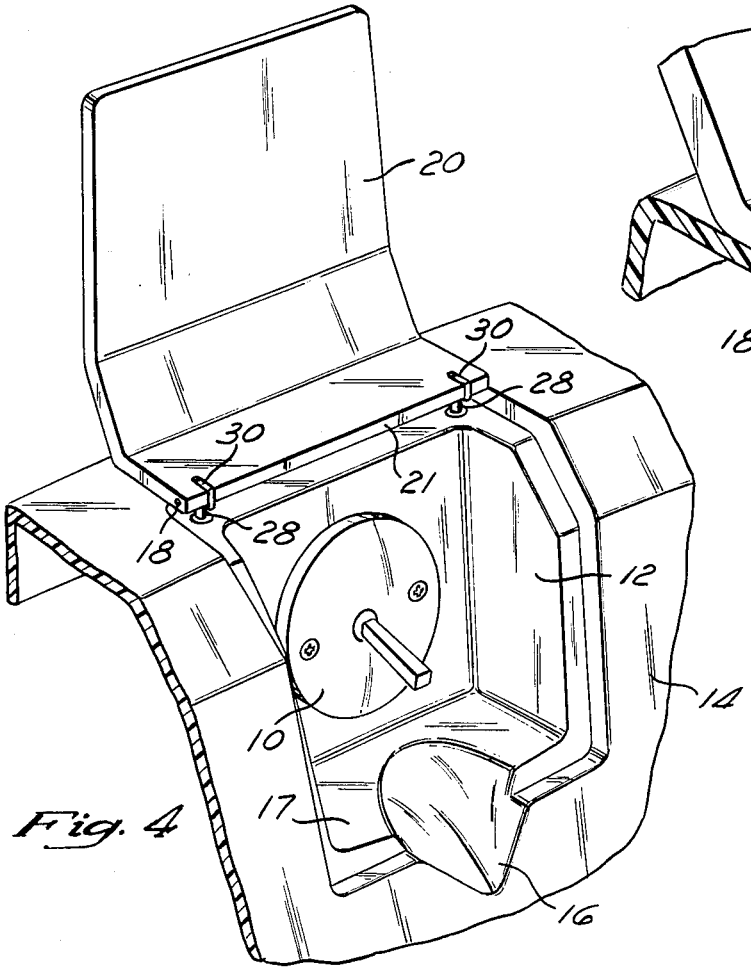
FIG. 4 is a perspective view showing the recess with the cover in open position, with a mechanism provided for pivotally connecting the cover to the recess.
Figure 6:
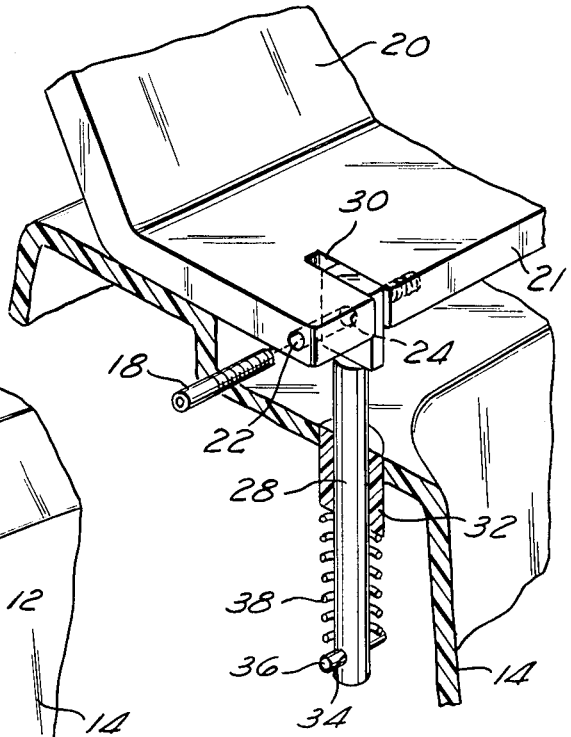
FIG. 6 is a side partly sectional view thereof with the cover in opened extending and projecting positions.
Figure 5:
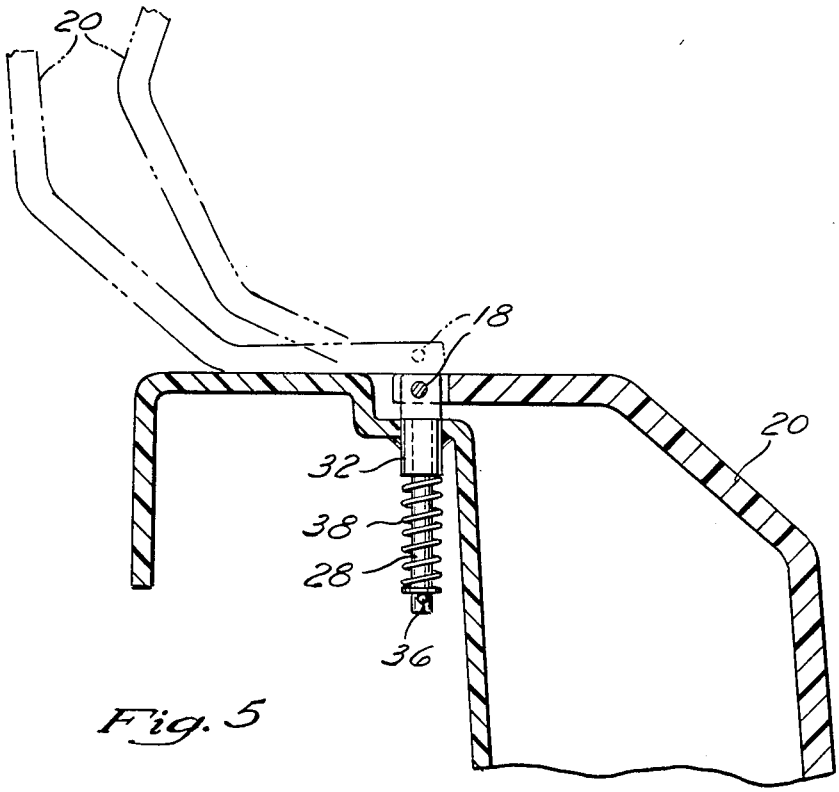
FIG. 5 is a partly fragmentary, partly-exploded, partly-sectional perspective view of the cover pivotally connecting mechanism.

Alternatively, cover 20 may be hinged at its back edge 21 by hinge pins 18, in the embodiment in FIGS. 4–6. Hinge pins 18 extend through side channels 22 in cover 20, and through an opening 24 in an enlarged head portion 26 at the upper end of the reciprocating rods 28. The enlarged head portions 26 of reciprocating rods 28 interfit into complementary slots 30 in cover 20. Reciprocating rods 28 extend through sleeves 32 mounted in bathtub wall 14, and include channels 34 at the lower ends thereof through which retainer pins 36 project. Springs 38 extend about the lower ends of rods 28 between retainer pins 36 and sleeves 32.

The cover 20, in the alternate embodiment in FIGS. 4–6, may be pivoted into two open positions (FIG. 5), first extending and then projecting upwardly from bathtub wall 14, by finger access to the front edge thereof through drain channel 16. The cover 20 is then pivoted upwardly about hinge pins 18 to the upwardly extending stable position thereof, so as to rest on the edge of the top opening-defining portion of the bathtub. Upon further pressure exerted so as to pivot the cover 20 to the upwardly projecting position thereof, with the cover resting on the top bathtub wall, the pivoting mechanism yields upwardly, preventing breaking thereof, with retainer pins 36 projecting upwardly, against the biasing pressure of springs 38. Springs 38 bias retainer pins 36 into retracted position, such that cover 20, upon release of cover-opening pressure thereon, returns to its stable upwardly extending position.

The recessed area 12 may contain apparatus such as valves, soap dishes, fluid jets, etc., in addition to the overflow valve, shown herein.

Various modifications will suggest themselves to those skilled in the art. Hence, I intend to be bound only by the claims which follow.

I claim:

1. A bathtub, including top and interior side and end walls defining continuous free-form contoured surfaces thereof, comprising:

(a) a recess formed in the bathtub end and top wall surfaces, which recess includes a bottom wall, a back wall, and opposed side walls, and opens into one end of the bathtub interior and the top portion thereof, the bathtub end and top wall surfaces including portions defining an opening therein substantially coextensive with the recess opening;

(b) a drain channel formed in the recess bottom wall and bathtub end wall surfaces and opening into the interior of the bathtub;

(c) a recess cover pivotally mounted in the top wall of the bathtub proximate the top of the back wall of the recess, adapted to be pivotable relative to the recess, between an opened position thereof extending upwardly and outwardly away from the interior of the bathtub, and a closed position thereof, overlying and covering the recess while not covering the drain channel, so as to be flush with, and continue the free-form contour of, the bathtub top and interior end wall surfaces adjacent the recess; and (d) means for pivotally mounting the recess cover in the top wall of the bathtub proximate the top of the back wall of the recess so as to enable the cover to be pivoted between positions opening and closing the recess.

2. A bathtub as in claim 1, in which the cover recess-opening position, to which the recess cover is adapted to be pivotable, and to which the pivotally mounting means are adapted to enable the recess cover to be pivoted, is a stable position.

3. A bathtub as in claim 1, which includes a drain, and a valve for controlling the flow of water through the drain, in which the bathtub further comprises a drain valve handle, connected to the drain valve, and mounted in the recess back wall so as to project into the recess in a generally horizontal direction from the recess back wall towards the interior of the bathtub, adapted to be covered by the recess cover upon closing thereof, and to be accessible to the user for controlling the flow of water through the drain upon opening of the recess cover.

4. A bathtub as in claim 1, in which the cover includes opposed side edges and a back edge thereof, and has an opening in each of the opposed side edges proximate the back edge thereof, and in which the recess cover pivotally mounting means comprise a pair of opposed aligned pins projecting from the sides of the bathtub top wall opening proximate the top of the back wall of the recess, adapted to engage the cover side edge openings for enabling the cover to pivot thereabout.

5. A bathtub as in claim 4, in which the cover side edge openings and the cover-mounting pivot pins extend generally horizontally.

6. A bathtub as in claim 1, in which the recess cover pivotally mounting means are adapted to enable the recess cover to be pivotally movable into a further opened position projecting beyond the extended open position thereof.

7. A bathtub as in claim 5, further comprising a pair of tubular sleeves mounted in the opposed sides of the top wall opening-defining portions in the end wall of the bathtub proximate the top of the back wall of the recess, and in which the cover pivotally mounting means comprise a pair of rods, extending through the sleeves, each including an upper extending enlarged head portion and upper rod portion, and a lower depending rod portion, the upper and lower rod portions of which are adapted to be reciprocally movable in the sleeves between cover-opened positions, in which the enlarged head portions extend from the sleeves, and in which the enlarged head portion and upper rod portion are adapted to project from each of the sleeves, means for pivotally connecting the upper enlarged head portion of each rod to the recess cover, and means for retaining the lower depending portions of the rods in the sleeves and for biasing the rods, in the cover-opened positions thereof, so as to extend from the sleeves.

8. A bathtub as in claim 7, in which the enlarged head portions at the upper ends of each of the pair of rods have an opening therein, the recess cover having a channel in each of the opposed side edges thereof proximate the cover back edge, and slots in each side of the back edge thereof generally complementary in shape and location to the enlarged head portion of each of the pair of rods, the rod enlarged head portions being interfittable in the cover back edge slots, the openings in the rod enlarged head portions being alignable with the channels in the recess cover, and in which the pivotally connecting means further comprise a pair of pins, each adapted to extend through the cover channels and rod head openings, for pivotally connecting the rods to the recess cover.

9. A bathtub as in claim 7, in which each of the pair of rods has an opening extending transverse to the length thereof proximate the lower depending end thereof, and in which the rod biasing means comprise pins insertable in and extendable from the rod transverse openings, and springs extendable about the rods between the tubular sleeve and the end extending pin.

10. A bathtub as in claim 7, in which the pivotally connecting pins extend generally horizontally, and in which the rods extend generally vertically.

* * * * *